US007828078B2

(12) United States Patent
Berger et al.

(10) Patent No.: US 7,828,078 B2
(45) **Date of Patent: *Nov. 9, 2010**

(54) SYSTEM FOR RAPIDLY BORING THROUGH MATERIALS

(75) Inventors: Wojciech Andrew Berger, Clarks Summit, PA (US); Robert A. Spalletta, Scranton, PA (US); Jerry A. Carter, Clarks Green, PA (US); Richard M. Pell, Dalton, PA (US); Marian Mazurkiewicz, Dallas, PA (US); Christopher Davey, Norwood, MO (US)

(73) Assignee: The University of Scranton, Scranton, PA (US)

( * ) Notice: Subject to any disclaimer, the term of this patent is extended or adjusted under 35 U.S.C. 154(b) by 122 days.

This patent is subject to a terminal disclaimer.

(21) Appl. No.: 11/886,372

(22) PCT Filed: Mar. 23, 2006

(86) PCT No.: PCT/US2006/011091

§ 371 (c)(1), (2), (4) Date: Oct. 15, 2008

(87) PCT Pub. No.: WO2006/105012

PCT Pub. Date: Oct. 5, 2006

(65) Prior Publication Data

US 2009/0071713 A1 Mar. 19, 2009

Related U.S. Application Data

(60) Provisional application No. 60/666,970, filed on Mar. 31, 2005.

(51) Int. Cl.
*E21B 7/04* (2006.01)

(52) U.S. Cl. ..... 175/14; 175/61

(58) Field of Classification Search ..... 175/11, 175/14, 61

See application file for complete search history.

(56) References Cited

U.S. PATENT DOCUMENTS 4,883,133 A * 11/1989 Fletcher et al. ..... 175/93
5,771,984 A * 6/1998 Potter et al. ..... 175/14
7,584,807 B2 * 9/2009 Berger et al. ..... 175/14

* cited by examiner

*Primary Examiner*—William P Neuder
(74) *Attorney, Agent, or Firm*—Riddle Patent Law; Charles L. Riddle, Esq.

(57) ABSTRACT

The present invention is a self-contained, high-energy liquid rock-boring system that will bore a small-diameter access hole [5] several hundred meters through hard granite and other obstacles within minutes of deployment. It employs a land unit [100] platform subsystem [1000] with an energetic fluid fuel reservoir [1300] and a boring subsystem [3000] having a plurality of pulsejets [3100]. Each pulsejet [3100] repeatedly ignites the energetic fluid [7] causing a plurality of rapidly-expanding gas bubbles [3250] which create and force a plurality liquid slugs [10] ahead of them rapidly out through a nozzle [3260] causing the slugs [10] to impact against materials ahead of the nozzles [3260], boring an access hole [5]. The system also employs an umbilical subsystem [2000] connecting the boring [3000] and the platform subsystems [1000]. The system can be used to rapidly bore an access hole [5] to provide air and resources to trapped miners. Alternatively, the system may also be used to bore an access hole [5] to underground threatening targets to neutralize them.

26 Claims, 9 Drawing Sheets

SYSTEM FOR RAPIDLY BORING THROUGH MATERIALS

CROSS REFERENCE TO RELATED APPLICATIONS

The present application claims priority from U.S. Provisional Patent Application "The Archimedes Javelin" Ser. No. 60/666,970 by Wojciech Andrew Berger, Robert A. Spalletta, Jerry A. Carter, Richard M. Pell, Marian Mazurkiewicz, Christopher Davey filed Mar. 31, 2005. The present Patent Application is also related to "Multiple Pulsejet Boring Device" by Wojciech Andrew Berger, Robert A. Spalletta, Jerry A. Carter, Richard M. Pell, Marian Mazurkiewicz and "Cryogenic Pulsejet" by Robert A. Spalletta both filed concurrently with this application. All of the above applications are hereby incorporated by reference as if set forth in its entirety herein.

BACKGROUND OF THE INVENTION

1. Field of the Invention

The present invention relates to system which rapidly bores a small diameter access hole through the ground materials in a specified direction.

2. Discussion of Related Art

In various emergency situations, it is necessary to quickly and accurately provide an access hole to underground voids or objects. In situations where miners are trapped beneath the surface, speed is critical to provide air, or to pump out ground water to keep them alive. This would be the first step in the rescue operations.

Speed is also critical in other emergency situations such as in neutralizing an underground terrorist weapons or bunkers. These must be neutralization before the enemy can take countermeasures.

In the case of an underground weapon or bunker, the prior art solution was to drop bunker-busting "bombs" on the surface above the underground target. These typically may be buried under up to 100 m of earth and stone.

Obviously, the prior art bombing techniques would not be suitable in situations where one would like to recover people, devices, materials, and information in the bunker unharmed. Therefore, underground rescue attempts for people trapped underground, such as miners or earthquake victims would have to use other means.

Also, these prior art methods would not be appropriate in situations where one would like to recover devices, materials, and information intact and undamaged, that were stored underground, such as in an underground bunker.

There have also been attempts to use water drilling to reach underground targets. These methods employ high-pressure water jets were used to cut through earth and stone. A large amount of power is required for rapid boring. The power delivered is related to the pressure of the water applied. Prior art equipment for this technology employed high-pressure water pumps. Due to the pressures required, the pumps will not be able to fit inside the hole and must be located outside of the hole, on a platform. Since there are resistive forces passing through a tube from outside of the hole to the drilling site, the pressure is significantly lower than that at the pump, reducing efficiency and taking much longer to bore a hole. Also, transmission of such pressures to the drilling site results in some other unsolved engineering problems.

There was also the prior art techniques using mechanical rotary drilling. These are not very fast and produce significant torques from the drilling rotation at the surface. A suitable platform must be constructed to anchor the device and to counter the torsional forces.

Therefore, there is a current need for a fast, efficient method of rapidly boring to underground objects or voids with minimal destruction.

SUMMARY OF THE INVENTION

One embodiment of the present invention is a rapid boring system for creating an access hole through materials to a desired location comprising:

a. a fuel reservoir [1300] for storing an energetic fluid [7];

b. combustion chamber [3230] for receiving energetic fluid [7], c. a nozzle [3260] in fluid communication with the combustion chamber [3230], for directing and speeding the flow of fluids provided to it, and d. an ignition device [3240] for causing the energetic fluid [7] to create a rapidly expanding bubble [3250] within combustion chamber [3230] causing a fluid slug [10] to be created and forced out of the nozzle [3260] at high speeds for boring an access hole [5] through rock and earth ahead of the slugs [10]; and e. an elongated umbilical subsystem [2000] having the proximal end and a distal end, with the proximal end in fluid communication with the fuel reservoir [1300], and the distal end connected to the boring subsystem [3000], the umbilical subsystem [2000] having at least one fluid conduit [2900] for passing the energetic fluid [7] from the fuel reservoir [1300] to the boring subsystem [3000] allowing the boring subsystem [3000] to rapidly bore said access hole [5] through said material to said desired location.

The present invention may also be embodied as a rapid boring system for creating and access hole in ground materials to desired underground location comprising:

a. A platform subsystem [1000] having a fuel reservoir [1300] for storing an energetic fluid [7];

b. a boring subsystem [3000] having a:

i. combustion chamber [3230] for receiving energetic fluid, ii. a nozzle [3260] in fluid communication with the combustion chamber [3230], for directing and speeding the flow of fluids provided to it, and aiming the fluid flow in provided to it, and iii. an ignition device [3240] for causing the energetic fluid [7] to create a rapidly expanding bubble within combustion chamber [3230] causing a fluid slug [10] to be created and forced out of the nozzle [3260] at high speeds for boring an access hole through rock and earth ahead of the slugs; and c. an elongated umbilical subsystem 2000 having the proximal end and a distal end, with the proximal and connected to the platform subsystem [1000], and a distal end connected to the boring device [3000], the umbilical subsystem [2000] having at least one fluid conduit [2900] passing through its length, the fluid conduit [2900] having a proximal end in fluid communication with fuel reservoir [1300], and having a distal end in fluid communication with the boring subsystem [3000], the fluid conduit [2900] acting to pass fluids between the platform [1000] and boring subsystems 3000.

The present invention may also be embodied as a method of rapidly boring an access hole [5] though ground materials comprising the steps of:

a) introducing a boring head into the ground having at least one pulsejet [3100] having a combustion chamber [3230] with a proximal end and a distal end, the distal end in fluid communication with an inlet valve [3210], and the distal end in fluid communication with a nozzle [3260], the combustion chamber 3230 also having an ignition device [3240] located between the inlet valve [3210] and the nozzle [3260];

b) providing an energetic fluid into the combustion chamber [3230];

c) igniting a portion of the energetic fluid [7] at an ignition device [3240] such that a rapidly-expanding bubble is formed in the energetic fluid [7] between the inlet valve [3210] and the nozzle [3260], thereby causing a fluid slug [10] to be created and forced out of nozzle [3260] at a high velocity, impacting the earth and rock, and thereby boring a hole in the earth and rock.

OBJECTS OF THE INVENTION

It is an object of the present invention to provide a system for rapidly boring an access hole to an underground objects and/or voids (targets").

It is another object of the present invention to provide a system for aiding in the rescue of people trapped underground.

It is another object of the present invention to provide a system for neutralizing underground weapons and bunkers.

It is still another object of the present invention to provide a method of boring holes horizontally under roads, highways, or buildings.

BRIEF DESCRIPTION OF THE DRAWINGS

The advantages of the instant disclosure will become more apparent when read with the specification and the drawings, wherein.

DETAILED DESCRIPTION OF THE INVENTION

The solution to boring a hole rapidly through a large amount of earth and stone is to remove extremely small amounts of the material very rapidly. A cylindrical borehole in granite, approximately 5 cm. in diameter and 100 m long, represents about 200,000 cc of granite weighing approximately 530 kg. Boring may be accomplished by pulverizing the earth and stone with powerful fluid jet technology and expelling it as a low-density multi-phasic slurry.

System Design

It operates by creating a series of expanding gas 'bubbles' in a liquid thereby splitting the fluid into fluid slugs and rapidly firing the fluid slugs into crevices of earth and rock creating a 'water hammer' effect.

The fluid slugs comminute stone and earth ahead of them causing rapid boring of an access hole. The fluid used in this process is stored at a base platform and is passed through an umbilical to a boring subsystem with multiple pulsejets. The pulsejets fire the slugs cutting the access hole.

Figure 1:
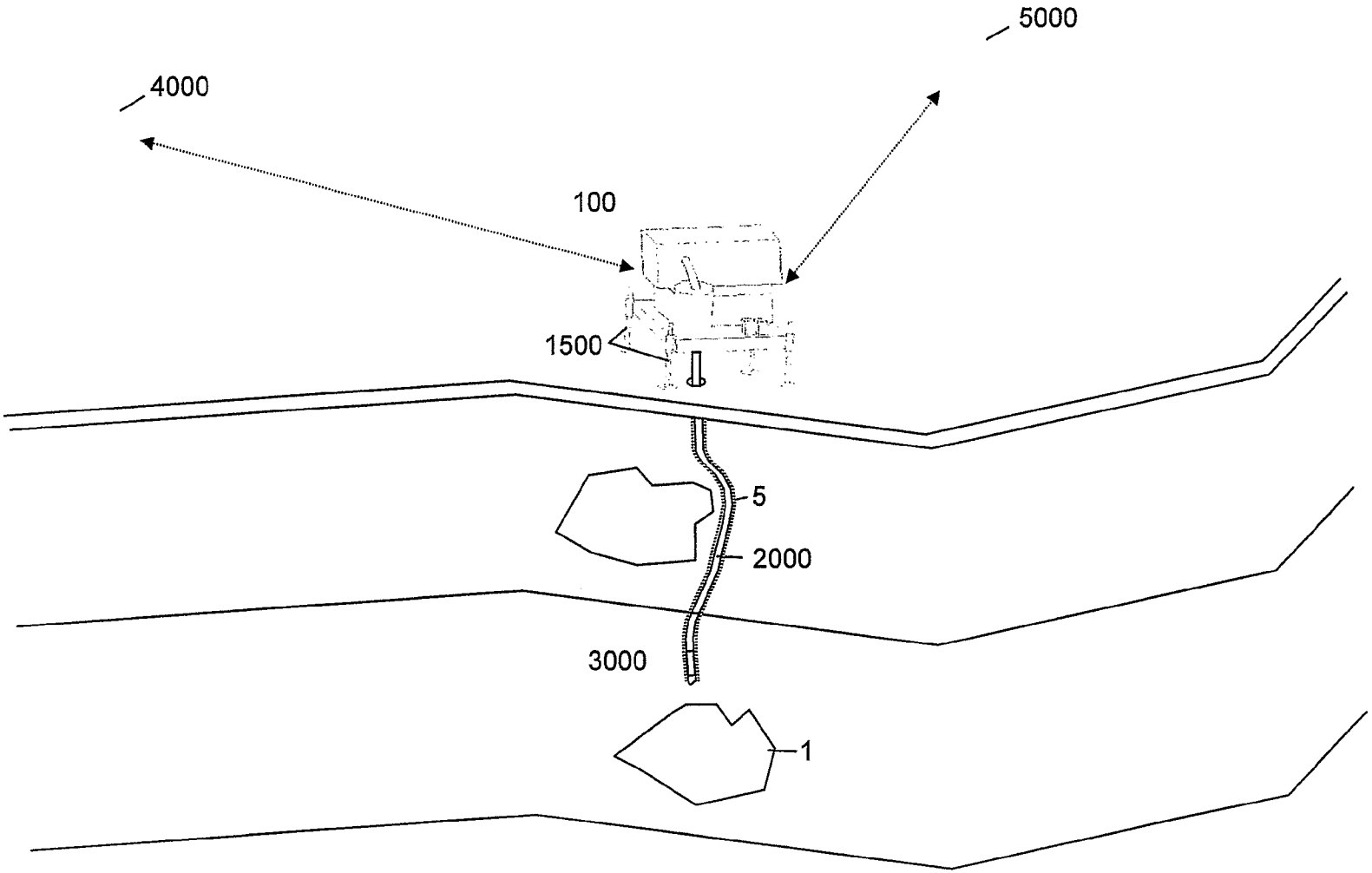
FIG. 1 is a perspective view of several ground units according to one embodiment of the present invention, as they appear in operation.

One embodiment of the present invention is shown in perspective view in FIG. 1. A ground unit 100 is placed on the ground just above a target 1 which may be an underground void or object. Ground unit 100 may be delivered there by a number of different conventional known methods including an air-drop for inaccessible locations.

Ground unit 100 employs a platform subsystem 1000 having retention and orientation devices 1500 which secure ground unit 100 to the ground and tilts platform 1000 to an optimum orientation for boring to target 1. Platform subsystem 1000 is designed to hold, store and carry all the equipment during deployment, initiate boring of an access hole, hold materials to be used in a fuel reservoir, stabilize ground unit 100 for boring, and communicate with other units.

A boring subsystem 3000 bores down through the ground toward target 1, creating an access hole 5. Boring subsystem 3000 is designed to force the excavated materials out of the access hole 5 and to the surface.

Boring subsystem 3000 is connected to platform subsystem 1000 by an umbilical subsystem 2000.

Umbilical subsystem 2000 connects the Platform 1000 and Boring 3000 subsystems. It acts to pass materials, electricity, and control signals between platform 1000 and boring 3000 subsystems.

Umbilical subsystem 2000 also employs mechanical actuators to absorb much of the forces produced during boring, as well as for steering and advancing umbilical subsystem 2000 and boring 3000 subsystems deeper into the access hole 5. Each subsystem is described in greater detail below.

Platform Subsystem

Figure 2:
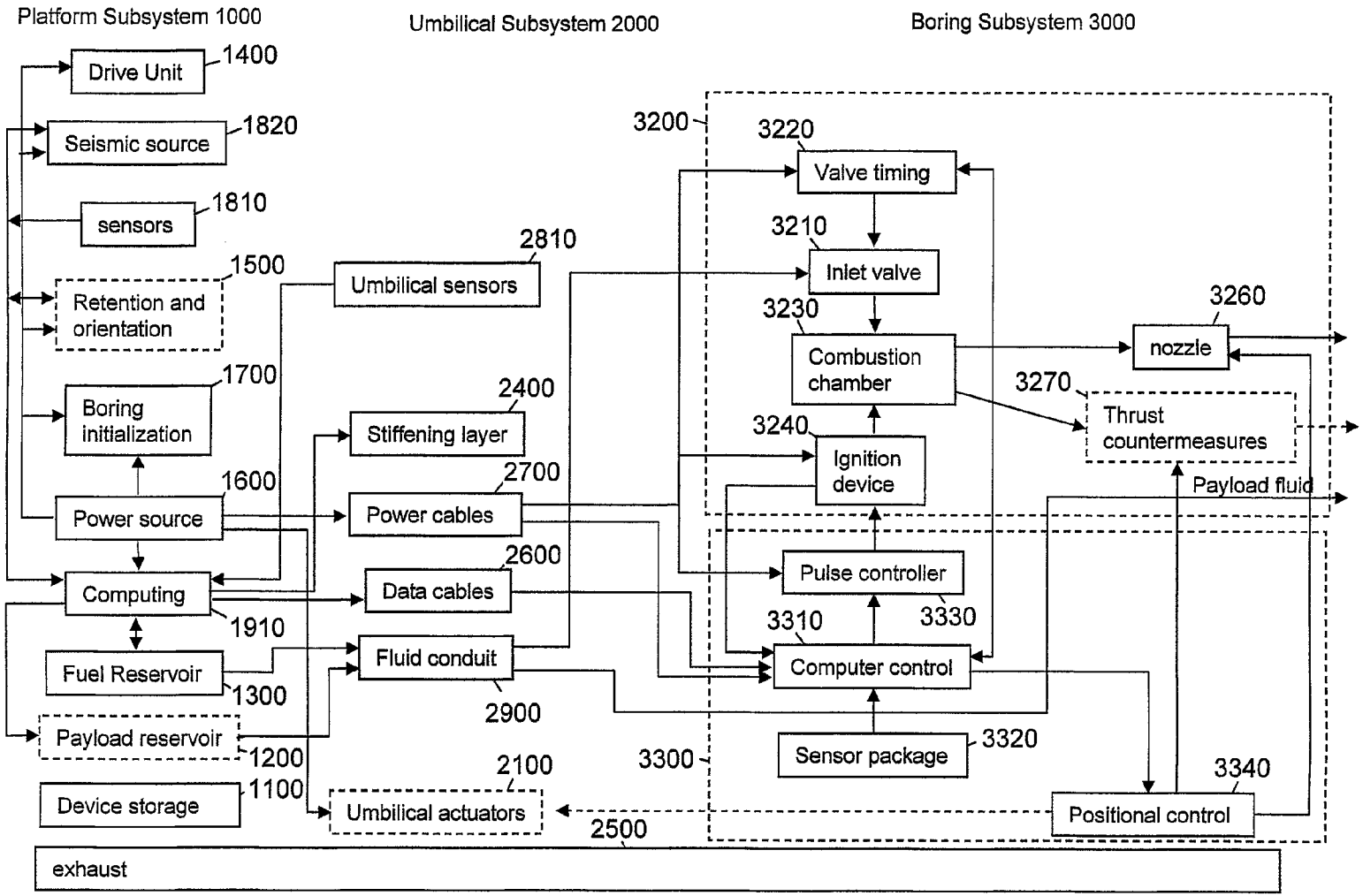
FIG. 2 is a schematic block diagram of a boring system according to one embodiment of the present invention.
Figure 3:
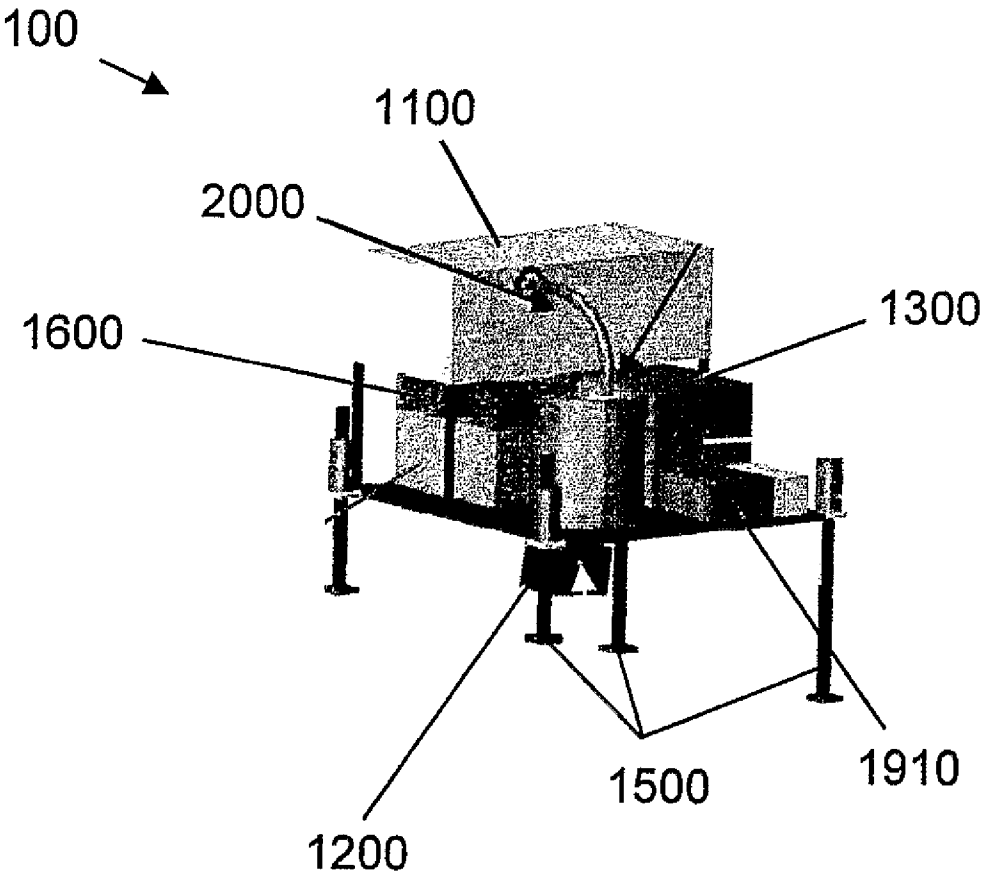
FIG. 3 is a perspective view illustrating an embodiment of the ground unit of the platform subsystem according to present invention.

Platform subsystem 1000 is shown and described in connection with FIGS. 2 and 3. Platform 1000 carries all the devices of ground unit 100 to an intended location. Therefore, umbilical subsystem 2000, boring system 3000 and all of their associate apparatus and supplies must be self-contained and stored on platform subsystem 1000.

Platform subsystem 1000 includes a device storage unit 1100. This has a feed mechanism and a drive unit with associated equipment capable of reeling in, or folding up, umbilical subsystem 2000 and boring subsystem 3000 for safe storage.

Platform subsystem 1000 may optionally also employ a payload reservoir 1200 which stores the material intended to be pumped through the umbilical into target 1 once it is reached. As stated above, this material may be a life support material, such as air or water to be provided to people trapped underground.

In an alternative embodiment, this may also be a gases or liquids which are used to neutralize underground bunkers, bombs or other dangerous devices.

An energetic fluid 7 used to perform the actual boring is stored in a fuel reservoir 1300 on platform 1000. This tank may have a compartment for more the one type of fluid. At least one of the fluids must have the capability of creating a rapidly expanding bubble to create and force liquid slugs at the rock and earth at the leading edge of the access hole 5.

One or more pumps (not shown) may be required to pump the energetic fluid 7 (and also the payload fluid) through umbilical subsystem 2000 to boring system 3000.

Transport Devices

A drive unit 1400 (not shown in FIG. 3) on platform subsystem 3000 transports ground unit 100 to a desired location for boring. This may include any commercially known means of transport over ground, water, or air, as required.

Ground Retention

Ground unit 100 must then secure itself to the ground for efficient functioning. Therefore, platform 1000 may employ retention and orientation devices 1500. These devices, attach to the ground by various means, such as drilling into the ground to anchor platform 1000. They hold platform 1000 to the ground so that it does not slip or move due to the effects of gravity (when on a steep hill), or do to mechanical effects from the rapid boring.

The retention and orientation devices 1500 also employ mechanical actuators, such as hydraulics or pneumatics to level or tilt platform when so that the angle of attack for boring is optimized.

Electric Power

The platform 1000 also employs an electric power source 1600 which provides power for all subsystems requiring electricity. Power source 1600 may be used for many purposes such as igniting energetic fluid, powering data communications, monitoring sensors, performing computations, controlling valves of boring subsystem 3000, and actuating the umbilical subsystem 2000.

It is estimated that the system will require less than one megawatt is required with sparking voltage of 10-20,000 volts having a low current flow (<100 amps).

Imaging Devices

Initial imaging of the target could be attained by some external underground imaging system and stored in ground unit 100 for later use. The present invention may also use its own active seismic devices to determine the location, depth, and rock properties (structure and seismic velocities) of the target.

The imaging system would consist of a seismic source 1820 and seismic sensors 1810 located on platform 1000. Umbilical sensors 2810 may be attached to umbilical subsystem 2000 which may also act as seismic sensors. A sensor package 3100 in boring subsystem 3000 may also include the seismic sensors.

The seismic source 1820 and seismic sensors 1810, umbilical sensors 2810 and sensor package 3320 are connected (directly or indirectly) to a computing device 1910 on platform 1000.

Seismic output waves are produced by seismic source 1820 and transmitted to the ground over the target area. Echoes are received by sensors 1810, umbilical sensors 2810, and sensor package 3320. There may be several seismic sources 1820 located various positions on the ground, platform 1000 or on the umbilical subsystem 2000. These may be fired in sequence from different locations and readings collected.

Computing device 1910 receives the sensor output, either by hard wire, or via telemetry. Seismic sensors 1810 are mounted at known locations on platform 1000. Also, the umbilical sensors 2810 could also include positional sensors which know how the umbilical subsystem 2000 is curved and positions of umbilical sensors 2810 along the length of the umbilical subsystem 2000. Therefore all of the sensor readings can be associated with a specific monitoring location.

Seismic signals are generated by a few small ordnance explosions from seismic source 1820. Knowing the positions of the seismic sensors, and reading the data from these sensors, the xyz coordinates could be derived of the underground structures, such as target 1. This would also provide information of the structure and seismic velocities of the ground material, and give an indication of the type of material.

Computing device 1910 then creates an underground image showing the target and other underground features. Computing device 1910 also monitors sensors on boring subsystem 3000 and umbilical subsystem 2000 and superimposes their locations on the underground image.

It is also possible to acquire a transmission image where sound waves are transmitted through the ground to sensors and the other side of a volume of the ground to be imaged. This process measures the transmission through the intervening ground, as opposed to reading echoes reflected back from objects in the ground. Transmission images could be acquired by having a seismic sources 1820 and seismic sensors 1810 attached to umbilical subsystem 2000 of at least two ground units. Seismic sources 1820 on an umbilical in the ground of a first ground unit transmit to sensors on an umbilical in the ground on a second ground unit. The transmission information is then measured.

This may then be reversed where the second ground unit transmits to the first ground unit.

A computing device 1910 of either or both ground units receives the sensor transmission information and converts the sensed signals by conventional methods into a transmission image of the ground between the umbilicals.

The transmission image constructed may be used by itself, or used in conjunction with the seismic reflection images described above.

In an alternate embodiment of the invention, seismic sensors having built in telemetry transmitters are dropped onto the ground. A small explosion is created to cause vibrations in the ground. The sensors detect the vibrations and radio the sensed signal back to a ground unit 100 and to computing device 1910.

Communications Unit

Alternatively, computing device 1910 and can communicate through a communications device 1922 other ground units 4000, 5000 as shown in FIG. 1 to send data, allocate tasks and operate together to achieve a common goal.

Umbilical Subsystem

The umbilical subsystem performs four key functions during the mission: (a) acting as a structural member assuring constant descent; (b) acting as a conduit for the energetic fluid 7 from the platform 1000 to boring subsystem 3000, (c) acting as a stable platform for propulsion and steering actuators mounted at intervals on the outer umbilical surface, and (d) acting as a delivery pump for pumping life-support or neutralizing materials from platform 1000.

Figure 5:
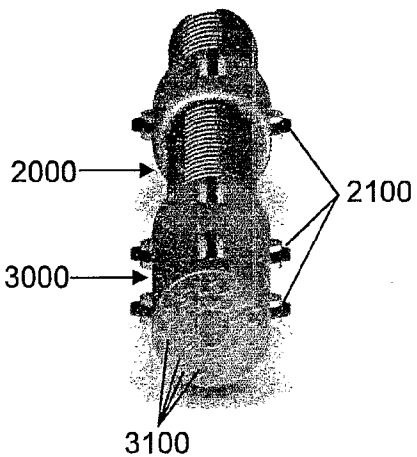
FIG. 5 is a perspective view of the umbilical subsystem and the boring subsystem of FIGS. 1-4.
Figure 4:
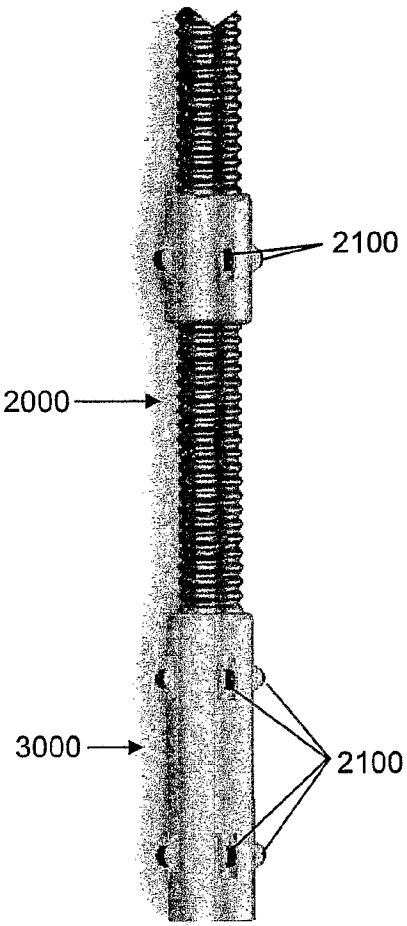
FIG. 4 is a side elevational view of an embodiment of the umbilical subsystem and the boring subsystem according to present invention.

One embodiment of the umbilical subsystem 2000 according to the present invention is shown in perspective views in FIGS. 4 and 5. Here it can be seen that the umbilical subsystem 2000 is designed to be flexible. Umbilical subsystem 2000 attaches to, and carries boring subsystem 3000 having a plurality of pulsejets 3100 located at its distal end.

Figure 6:
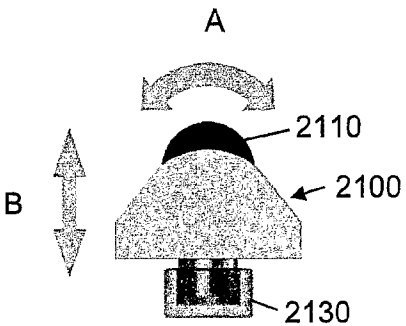
FIG. 6 is a side elevational view of an embodiment of the umbilical actuators according to present invention.

Umbilical subsystem 2000 employs a plurality of umbilical actuators 2100 on its periphery. In this embodiment as shown in FIGS. 4-6, umbilical actuator 2100 has a linear actuator 2130 to allow it to engage or disengage the wall of the access hole 5 by moving in the direction of the arrow marked "B".

Umbilical actuator 2100 also employs a wheel 2110 which rotates in the direction of the arrow marked "A". When it is in contact with access hole wall 5, wheel 2110 can cause the umbilical to be forced into, or out of the access hole 5.

The umbilical has a cylindrical thick-walled tube which is stored as a flexible, folded hose on platform subsystem 1000 as described above. Upon deployment, umbilical subsystem 2000 is fed into the access hole 5 as a rigid structural pipe by the drive unit of device storage unit 1110.

The umbilical subsystem 2000 is designed to sustain up to 5 MPa of axial stress from the 5000 N thrust force of the pulsejet. Spring-loaded spacers (not shown) may be employed to preclude any lateral deflection and buckling. Boring subsystem 3000 bores the access hole 5 without any mechanical rotation, thereby minimizing torques acting upon the umbilical.

Figure 7:
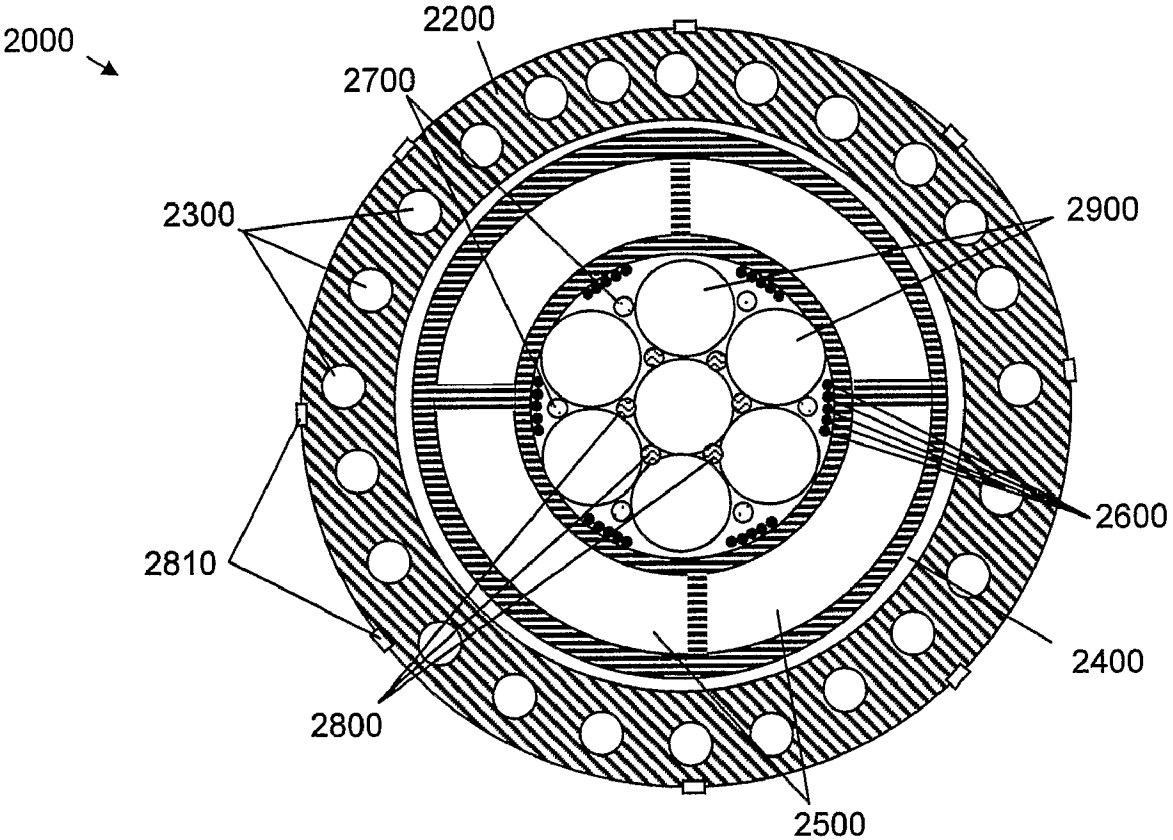
FIG. 7 is a transverse cross-sectional view of one embodiment of umbilical subsystem 2000 according to the present invention.

FIG. 7 is a transverse cross-sectional view of one embodiment of umbilical subsystem 2000 according to the present invention. Similarly, FIG. 8 is a longitudinal cross-sectional view of the umbilical subsystem 2000 of FIG. 7 from the outer skin to the center line ("C/L").

Figure 8:
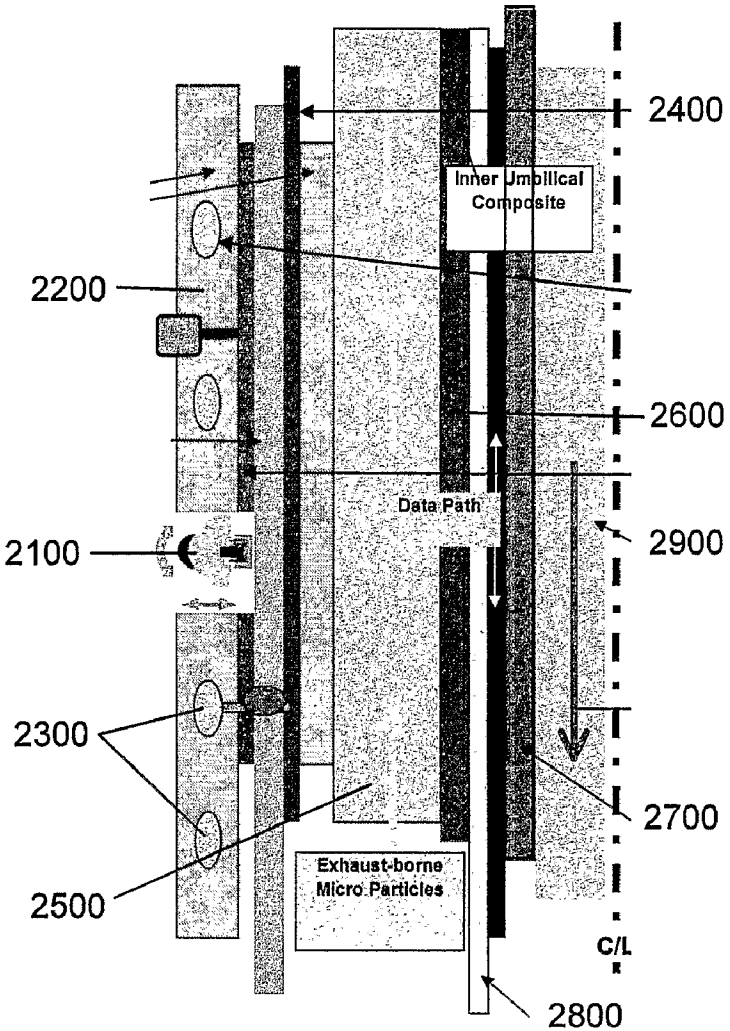
FIG. 8 is a longitudinal cross-sectional view of the umbilical subsystem 2000 of FIG. 7 from the outer skin to the center line ("C/L").

Referring now both to FIGS. 7 and 8, umbilical subsystem 2000 is designed to change from a folded-hose stored on platform 1000 to a rigid pipe having a plurality of internal conduits 2900. A thick outer skin 2200 is preferably constructed of a thermoplastic/ceramic/graphite-fiber composite material with approximately 10-20 GPa flex and tensile moduli. This allows umbilical subsystem 2000 to have the proper structural strength and flexibility characteristics as well as abrasion resistance. Preferably, umbilical skin 2200 is intended to be heated to increase flexibility.

The energetic fluid is pumped at 7 MPa through the umbilical in a central core plastic tube(s) acting as fluid conduits 2900 which preferably have a cross-section areas of 0.5-1.0 square cm.

Umbilical subsystem 2000 may optionally actuate selected segments of the umbilical subsystem 2000, causing it to curve, steering it.

Since umbilical subsystem 2000 is flexible and/or made of segments, it may require stiffening in order to steer it and push it through the access hole 5. Therefore there is a concentric stiffening layer 2400, which when activated causes umbilical subsystem 2000 to become less flexible and more rigid. One such method of causing this change is used electro-rheological fluids which change viscosity and hence the rigidity of the umbilical once supplied with electric power.

There is also a plurality of exhaust conduits 2500 passing along the length of the umbilical subsystem 2000 allowing comminuted material blasted away by boring subsystem 3000 to be forced upward through exhaust conduits 2500 and out of access hole 5.

Data cables 2600 pass through the length of umbilical subsystem 2000 and carry information between boring 3000, umbilical 2000 and platform 1000 subsystems. This information may be control signals running actuators, sensed signals intended to be monitored and processed, and other signals required for the device to operate effectively.

Power cables 2700 provide electric power from power source 1600 to any devices requiring electric power to operate.

Optical fibers 2000 may also be used for a variety of purposes, including data communication throughout the system.

Umbilical sensors 2100 shown here in outer skin 2200 may also be located in a number of different areas to monitor stresses, strains, pressures, temperatures, chemical, radioactive and other physical characteristics over umbilical subsystem 2000.

For example, these sensors can monitor the exhaust pressure in exhaust conduits 2500, measure the pressure and temperature of energetic fluids include conduits 2900, monitor position of each segment of umbilical subsystem 2000 to determine the location of each of its segments and the boring subsystem 3000. All of this information may pass though data cables 2600 to computing device 1910 of platform 1000. Computing device 1910 may then determine if the invention is functioning properly, and if not, to take corrective action. Computing device 1910 may also steer the umbilical 2000 and boring 3000 subsystems.

Boring Subsystem

Figure 9:
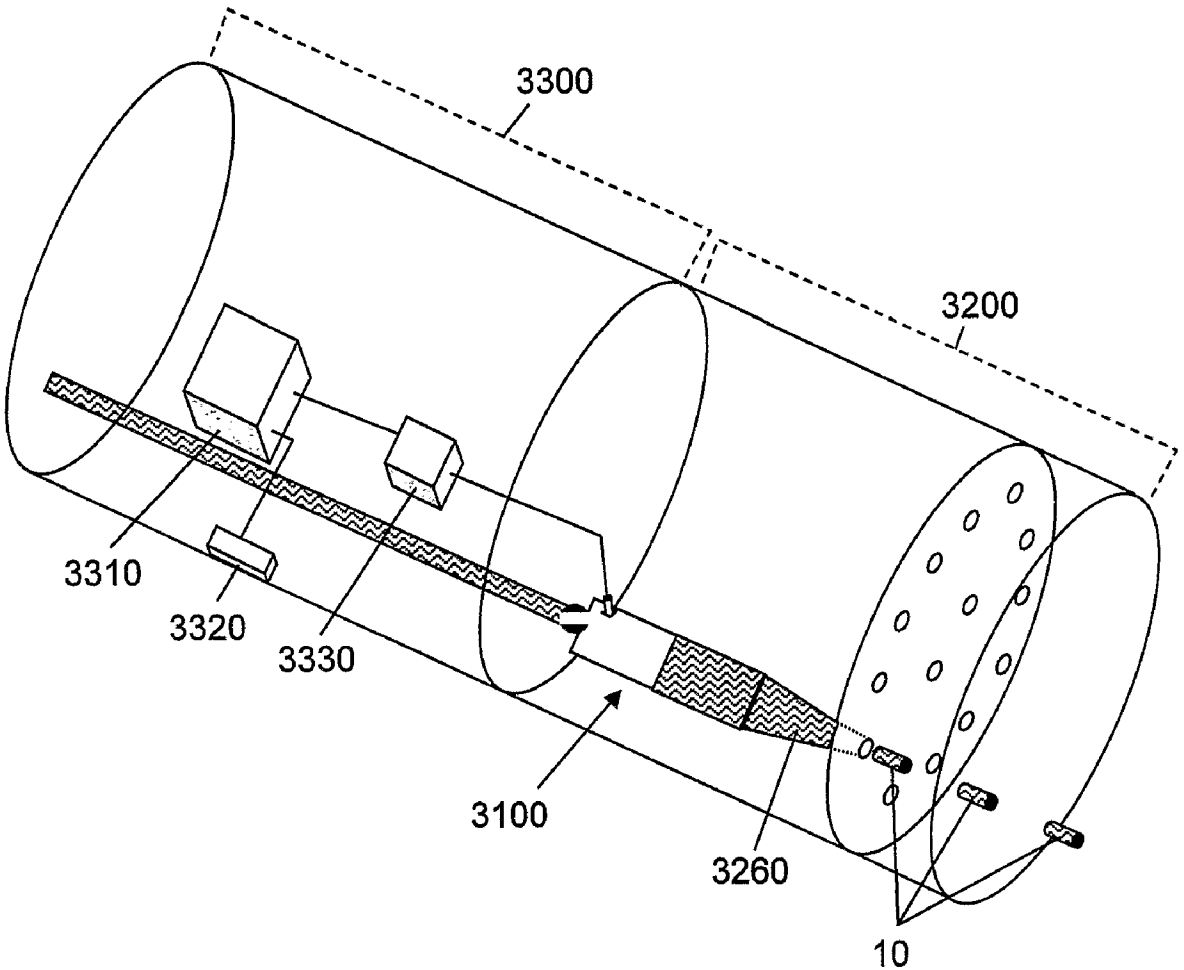
FIG. 9 is a perspective view of one embodiment of a boring subsystem 3000 according to the present invention.

FIG. 9 is a perspective view of one embodiment of a boring subsystem 3000 according to the present invention. The end of the boring subsystem 3000 is a boring head 3200 containing ten to twenty pulsejets 3100. Pulsejets 3100 receive energetic fluid 7, and cause the fluid to create a rapidly expanding bubble forcing portions of the fluid out of a nozzle 3260 at high speeds as a plurality of fluid slugs 10. Since the fluid used is highly incompressible, the impact of slugs 10 bores through rock and earth.

Boring head 3200 will likely be constructed from a high tensile strength, high temperature material capable of withstanding significant sand blasting effects. This may be a metal matrix ceramic or other type composite material.

Boring Body

A boring body 3300 behind boring head 3200 protects and houses a pulse controller 3330 for causing the ignition of the energetic fluid 7. It also encloses a sensor package 3320, for sensing physical properties related to the boring subsystem 3000. Boring body 3300 includes a positional control unit 3340 for adjusting the course of the boring head 3200. Boring Body 3300 also includes a computer control 3310.

Computer Control

Computer control 3310 and pulse controller 3330 determine when to ignite the energetic fluid 7. Pulse controller 3330 causes an ignition device 3240 to ignite energetic fluid 7 in a combustion chamber 3230 at the proper instant to cause a slug 10 to be formed and fired out of nozzle 3260.

Computer control unit 3310 will calculate when nozzle 3260 encounters target 1. By sensing physical parameters through sensor package 3320, computer control unit 3310 can detect voids, fluids, etc. in the ground near boring head 3200. This may be based upon the rate of penetration and applied pressures. Computer control unit 3310 will receive data from the sensors in sensor package 3320 and potentially interact with computing device 1910 of platform 1000 to determine the direction which to bore to most effectively reach target 1. The control of boring subsystem 3000 steering it toward target 1 is more fully explained in co-pending patent application entitled "Multiple Pulsejet Earth Boring Device" hereby incorporated by reference as if set forth in its entirety herein.

FIGS. 10*a*-10*h* are time-sequenced illustration showing the functioning of pulsejet 3100.

Figure 10:
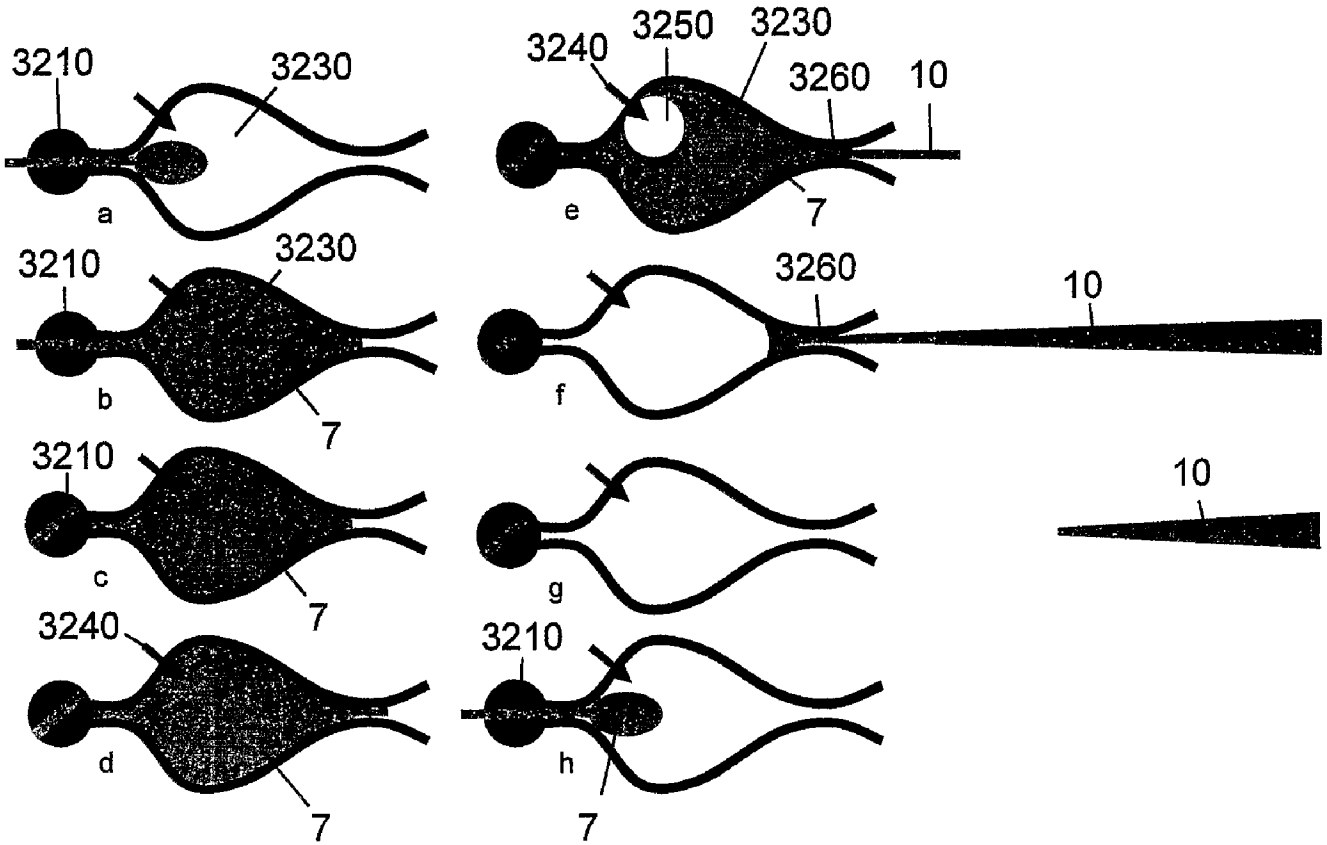
FIGS. 10*a*-10*h* are time-sequenced illustration showing the functioning of pulsejet 3100.

In FIG. 10*a*, energetic fluid 7 passes through open inlet valve 3210 and into combustion chamber 3230. Energetic fluid 7 is illustrated as the crosshatched area.

In FIG. 10*b*, inlet valve 3210 is still open as combustion chamber 3130 is filled with energetic fluid 7.

In FIG. 10*c* inlet valve 3210 is closed.

In FIG. 10*d*, ignition device 3240 ignites energetic fluid 7 and creates a rapidly expanding bubble 3250.

In FIG. 10*e*, bubble 3250 continues to expand, forcing energetic fluid 7 out of nozzle 3260, since there is only one direction to expand, since inlet valve 3210 is closed.

In FIG. 10*f*, almost all of the energetic fluid 7 has been forced out of nozzles 3260 as a high-velocity fluid slug 10.

In FIG. 10*g*, in a small period of time passes before the cycle is repeated, thereby allowing spacing between fluid slugs 10.

In FIG. 10*h*, inlet valve 3210 is open again beginning the cycle as in FIG. 10*a* above.

Operation

Figure 11:
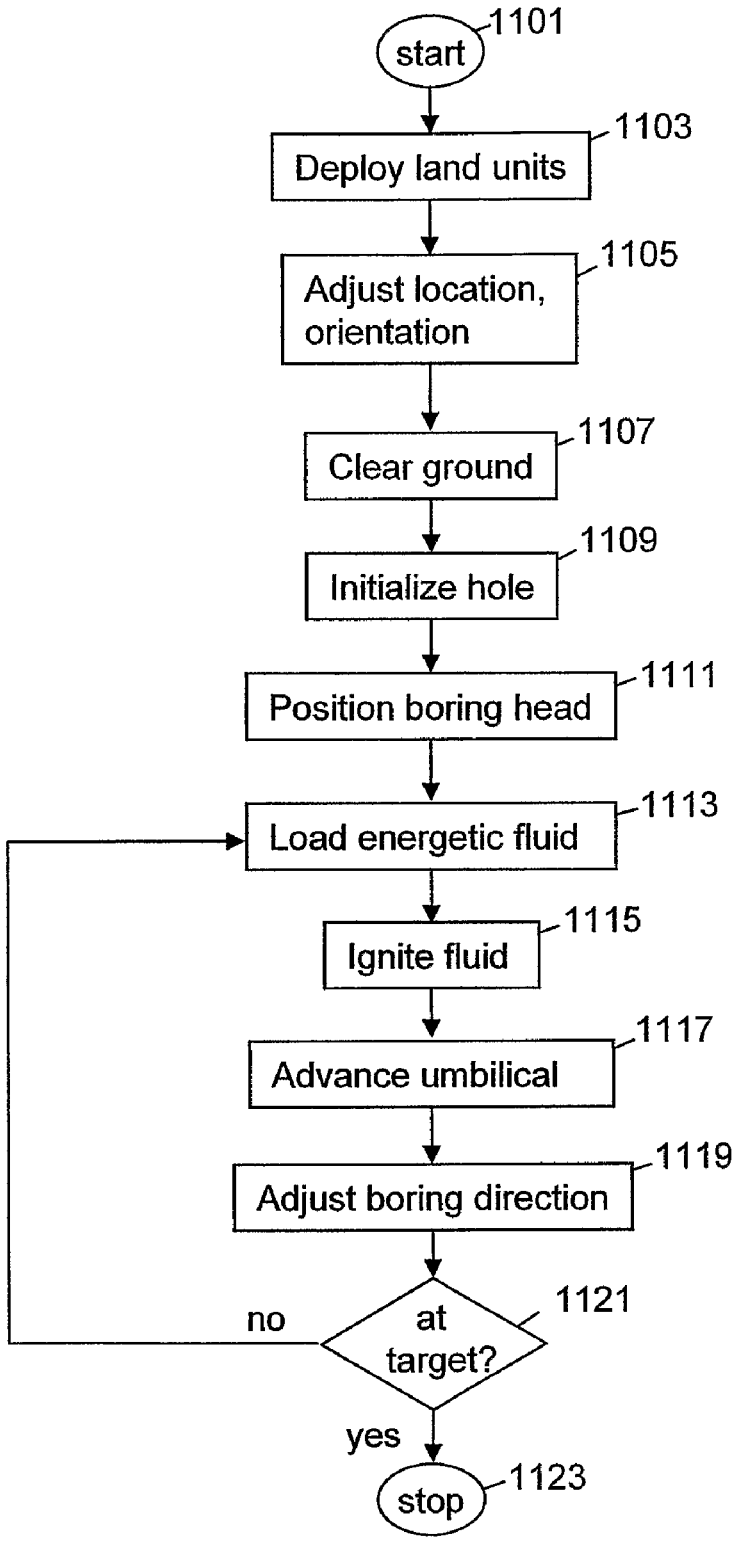
FIG. 11 is a flowchart illustrating the functioning of the present invention.

The operation of the present invention is set forth in FIG. 11. The process starts at step 1101. In step 1103, the present invention is delivered by a conventional vehicle to a location on the surface approximately above the target. In areas which are inaccessible to humans due to terrain or other dangers, ground units 100 may be air-deployed.

If air deployed, aircraft or pilotless drones would drop the present invention by parachute to the surface. The land units 100 may require a righting device to flip it to have the correct side up.

If air-delivered, the present invention preferably should be 3-4 cubic meters and weigh less than 2,000 kg. The volume of engineered fluid based upon the above pulsejet design may range from 200-400 liters, being less than 0.5 cu. m. The folded umbilical could be constructed to require less than 0.5 cu. m. including the feed mechanism and drive unit.

In step 1105, land unit 100 employs its pre-stored underground imagery. This imagery was acquired by conventional means prior to deployment and includes the target area. Land unit 100 may also perform its own imagery and/or use GPS readings to determine where it is to be located. The imagery and coordinates may also be provided by another source in communication with land unit 100.

Ground unit 100 may use a land drive device to move it to the proper location above target 1. Once at the proper location, retention grippers hold the land unit to the ground and secure it. Penetration vectors may be calculated from its underground imagery to adequately penetrate the key portions of underground target 1. The retention and orientation device 1500 orients the platform at the optimum angle.

In step 1107, the ground surface above the target is cleared with fast-acting defoliants and/or thermal explosions.

In step 1109 a starter hole is initialized. A small quick-acting explosively is employed to punch a small hole in the ground.

In step 1111 the boring head 3200 into the initialization hole.

In step 1113 energetic fluid 7 is loaded into the combustion chamber 3230 of at least one of the pulsejets 3100 on boring head 3200.

In step 1115, the energetic fluid in the combustion chamber 3230 is ignited causing a rapidly-expanding bubble 3250 to be formed in the energetic fluid 7 and a fluid slug 10 to be created and forced out of the nozzle 3260 of the pulsejet 3100 at a high velocity, impacting the earth and rock.

In step 1117, the umbilical subsystem 2000 is advanced into access hole 5 using umbilical actuators 2100.

In step 1119, the direction is iteratively adjusted using imagery by adjusting the firing of the pulsejets 3100 of the boring head 3200. It also may be steered by selectively actuating portions of the umbilical as described above.

In steps 1121 it is determined if the boring head 3200 has reached target 1. If not ("no"), then steps 1113-1121 are repeated.

If the target is encountered in step 1121 ("yes"), an access hole has been successfully bored from the surface to target 1 and the process stops at step 1123. Therefore, after several minutes, the invention has drilled a borehole to target 1.

Access hole 5 may be used to allow excess gas or other fluids to be removed, allow cable or wires to be introduced into target 1, insert pipes to pump out fluids or to pump in a material.

The material pumped into the target may be a life-support material such as air or water.

Alternatively, the material pumped into the target may be a neutralizing material such as non-lethal gases to neutralize people and equipment underground.

The material may also be carbon particles which could incapacitate occupants, short out electrical equipment, disrupt environmental cleaning air movement systems, and destroy communications capabilities. The materials may also be chemicals that convert site support stored fluids such as cooling water or diesel fuels into a thick non-pumpable gel may also be dispensed.

Finally the materials may also be lethal materials.

The present invention locates and provides an access hole to underground targets. These may be located in areas that are inaccessible to humans, due to the danger or hazardous environment. The present invention will function more quickly and accurately than the prior art devices.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A rapid boring system for creating an access hole through materials to a desired location comprising:

a. a fuel reservoir [1300] for storing an energetic fluid [7];

b. combustion chamber [3230] for receiving energetic fluid [7], c. a nozzle [3260] in fluid communication with the combustion chamber [3230], for directing and speeding the flow of fluids provided to the nozzle, and d. an ignition device [3240] for causing the energetic fluid [7] to create a rapidly expanding bubble [3250] within combustion chamber [3230] causing a fluid slug [10] to be created and forced out of the nozzle [3260] at high speeds for boring an access hole [5] through rock and earth ahead of the slugs [10]; and e. an elongated umbilical subsystem [2000] having a proximal end and a distal end, with the proximal end in fluid communication with the fuel reservoir [1300], and the distal end connected to the boring subsystem [3000], the umbilical subsystem [2000] having at least one fluid conduit [2900] for passing the energetic fluid [7] from the fuel reservoir [1300] to the boring subsystem [3000] allowing the boring subsystem [3000] to rapidly bore said access hole [5] through said material to said desired location.

2. The rapid boring system of claim 1, further comprising a power source [1600] for providing electric energy to devices requiring electric power.

3. The rapid boring system of claim 1, further comprising power cables [2700] connected to power source [1600] on platform subsystem for passing the electric energy to devices requiring electric power.

4. The rapid boring system of claim 1, further comprising a payload reservoir [1200] for storing a life-support fluid intended to be passed into the target [1] through the umbilical subsystem [2000].

5. The rapid boring system of claim 1, wherein the boring head further includes pulse controller [3330] for controlling the ignition device [3240] to ignite the energetic fluid [7] at the proper time to create a fluid slug [10] of the proper size.

6. The rapid boring system of claim 1, further comprising an exhaust conduit [2500] for passing ground materials from the boring head [3200] out of the access hole [5].

7. The rapid boring system of claim 1, further comprising a positional control [3340] coupled to the nozzle [3260] and computer control [3310], for aiming nozzle [3260] in the proper direction to intersect target [1].

8. The rapid boring system of claim 1, further comprising umbilical actuators [2100] on umbilical subsystem [3000], for moving umbilical subsystem [2000] into, or out of access hole [5].

9. The rapid boring system of claim 1, further comprising a computing device [1910] for receiving input from sensors and for computing a route to target [1].

10. The rapid boring system of claim 1, further comprising a communication device [1930] for communicating with other land units.

11. The rapid boring system of claim 1, further comprising a thrust countermeasure device [3270] acting to counter forces created from boring which would expel umbilical subsystem [2000] from access hole [5].

12. A rapid boring system for creating an access hole in ground materials to a desired underground target location comprising:

a. A platform subsystem [1000] having a fuel reservoir [1300] for storing an energetic fluid [7];

b. a boring subsystem [3000] having a:

i. combustion chamber [3230] for receiving energetic fluid [7], ii. a nozzle [3260] in fluid communication with the combustion chamber [3230], for directing and speeding the flow of fluids provided to the nozzle, and iii. an ignition device [3240] for causing the energetic fluid [7] to create a rapidly expanding bubble [3250] within combustion chamber [3230] causing a fluid slug [10] to be created and forced out of the nozzle [3260] at high speeds for boring an access hole [5] through rock and earth ahead of the slugs [10]; and c. an elongated umbilical subsystem [2000] having a proximal end and a distal end, with the proximal and connected to the platform subsystem [1000], and a distal end connected to the boring subsystem [3000], the umbilical subsystem [2000] having at least one fluid conduit passing through its length, the fluid conduit [2900] having a proximal end in fluid communication with fuel reservoir [1300], and having a distal end in fluid communication with the boring device [3000], the fluid conduit [2900] acting to pass fluids between the platform subsystem [1000] and the boring device [3000].

13. The rapid boring system of claim 12, further comprising data cables [2600] for passing data between the platform subsystem [1000] and the boring subsystem [3000].

14. The rapid boring system of claim 12, further comprising a power source [1600] on platform subsystem [1000] for providing electric energy to devices requiring electric power.

15. The rapid boring system of claim 12, further comprising power cables [2700] connected to power source [1600] on platform subsystem [1000] for passing the electric energy to devices requiring electric power.

16. The rapid boring system of claim 12, further comprising a payload reservoir [1200] for storing a life-support fluid intended to be passed into the target 1 through umbilical subsystem [2000].

17. The rapid boring system of claim 12, wherein the boring head [3200] further includes pulse controller [3330] for controlling the ignition device [3240] to ignite the energetic fluid [7] at the proper time to create a fluid slug [10] of the proper size.

18. The rapid boring system of claim 12, further comprising an exhaust conduit [2500] for passing ground materials from the boring head [3200] out of the access hole [5].

19. The rapid boring system of claim 12, further comprising a positional control [3340] coupled to the nozzle [3260] and computer control [3310], for aiming nozzle 3260 in the proper direction to intersect target [1].

20. The rapid boring system of claim 12, further comprising umbilical actuators [2100] on umbilical subsystem [3000], for moving umbilical subsystem [2000] into, or out of access hole [5].

21. The rapid boring system of claim 12, further comprising a computing device [1910] for receiving input from sensors and for computing a route to target [1].

22. The rapid boring system of claim 12, further comprising a communication device [1930] for communicating with other land units.

23. The rapid boring system of claim 12, further comprising a thrust countermeasure device [3270] acting to counter forces created from boring which would expel umbilical subsystem [2000] from access hole [5].

24. A method of rapidly boring an access hole though ground materials with an energetic fluid comprising the steps of:

a) introducing a boring head [1111] into the ground having at least one pulsejet [3100] having a combustion chamber [3230] with a proximal end and a distal end, the distal end in fluid communication with an inlet valve [3210], and the distal end in fluid communication with a nozzle [3260], the combustion chamber [3230] also having an ignition device [3240] located between the inlet valve [3210] and the nozzle 3260;

b) providing said energetic fluid [7] into the combustion chamber [3230];

c) igniting a portion of the energetic fluid [1115] at an ignition device [3240] such that a rapidly-expanding bubble 3250 is formed in the energetic fluid [7] between the inlet valve [3210] and the nozzle [3260], thereby causing a fluid slug [10] to be created and forced out of nozzle [3260] at a high velocity, impacting the earth and rock, and thereby boring an access hole [5] in the ground.

25. The method of claim 24 further comprising the step of advancing the umbilical subsystem [1117] further into the access hole [5].

26. The method of claim 24 further comprising the step of adjusting the direction which the boring head is pointing [1119] so that it intersects the target.

* * * * *